US007925176B2

(12) United States Patent
Kyung

(10) Patent No.: US 7,925,176 B2
(45) Date of Patent: Apr. 12, 2011

(54) TRANSFER VOLTAGE CONTROL METHOD OF IMAGE FORMING APPARATUS

(75) Inventor: Myung-ho Kyung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 623 days.

(21) Appl. No.: 12/013,760

(22) Filed: Jan. 14, 2008

(65) Prior Publication Data

US 2008/0285995 A1 Nov. 20, 2008

(30) Foreign Application Priority Data

May 15, 2007 (KR) ..... 10-2007-0047194

(51) Int. Cl.
*G03G 15/16* (2006.01)
*G03G 15/08* (2006.01)
*G03G 15/01* (2006.01)
*G03G 15/20* (2006.01)

(52) U.S. Cl. ..... 399/66; 399/121; 399/302; 399/308; 399/313; 399/314

(58) Field of Classification Search ..... 399/66, 399/121, 302, 308, 313, 314
See application file for complete search history.

(56) References Cited

U.S. PATENT DOCUMENTS

| | | | | |
|---|---|---|---|---|
| 5,953,556 | A * | 9/1999 | Yamanaka | 399/66 |
| 6,246,847 | B1 * | 6/2001 | Jeong et al. | 399/101 |
| 7,062,186 | B2 * | 6/2006 | Kyung | 399/66 |
| 7,580,650 | B2 * | 8/2009 | Kitamura | 399/72 |

FOREIGN PATENT DOCUMENTS

| | | |
|---|---|---|
| JP | 5-6112 | 1/1993 |
| JP | 8-160784 | 6/1996 |
| JP | 2000-162888 | 6/2000 |

* cited by examiner

*Primary Examiner* — David M Gray
*Assistant Examiner* — Joseph S Wong
(74) *Attorney, Agent, or Firm* — Stanzione & Kim, LLP

(57) ABSTRACT

A transfer voltage control method of an image forming apparatus includes supplying a first measurement voltage to a first transfer member and a second transfer member, measuring a variation in resistance of the first transfer member by supplying a second measurement voltage to the first transfer member during a first period of time, and measuring a variation in resistance of the second transfer member by supplying the second measurement voltage during a second period of time. Therefore, it is capable of measuring accurately a variation in resistance of a transfer unit, such that an optimum transfer voltage may be set. Accordingly, transfer quality of an image forming apparatus is improved.

17 Claims, 3 Drawing Sheets

TRANSFER VOLTAGE CONTROL METHOD OF IMAGE FORMING APPARATUS

CROSS-REFERENCE TO RELATED APPLICATIONS

This application claims priority under 35 U.S.C. §119 from Korean Patent Application No. 10-2007-0047194, filed on May 15, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to a transfer voltage control method of an image forming apparatus.

2. Description of the Related Art

A conventional image forming apparatus of a transfer photographic method may include a feeding unit, an optical transfer apparatus, a developing unit, a transfer unit, a fixing unit, and a discharge unit.

A sheet of paper picked up from the feeding unit passes the developing unit, and the transfer unit, an image is printed on the sheet of paper, the image is fixed on a sheet of paper by the fixing unit, and the sheet of paper is discharged externally through the discharge unit.

Toner is pasted onto a latent image formed on a photoconductive medium, or a toner image is transferred from a photoconductive medium to a transfer unit or from a transfer unit to a sheet of paper using a difference in electrical potential of each apparatus. A proper transfer voltage has to be supplied to the transfer unit to transfer the toner image on the photoconductive medium onto the sheet of paper. A variation in resistance and an optimum transfer voltage are measured prior to printing. The optimum transfer voltage may be approximately +1200V to +1400V.

A color image forming apparatus may include a transfer unit including a first transfer member and a second transfer member to transfer an image using a plurality of colors. Recently, as demand for high speed color image forming apparatuses has increased, a first transfer member has been provided in a transfer drum to improve printing speed, and a structure in which uncontacted developer is used has been suggested.

A transfer unit including a plurality of transfer members has the problem that variation in the resistance of each transfer member cannot be accurately measured. For example, when the variation in the resistance of the first transfer member is measured, the variation in the resistance is measured according to a current variation by supplying a measurement voltage 500~600V to the first transfer member. The voltage is also supplied to the second transfer member and the photoconductive medium contacting the first transfer member, and the variation in the resistance of the first transfer member is measured including the resistance values of the second transfer member and the photoconductive medium. As a result, the measured variation in resistance may be inaccurate. When a variation in current is measured by supplying a measurement voltage to the second transfer member to recognize a variation in the resistance of the second transfer member, errors of the measured variation in the resistance may be increased.

As an optimum transfer voltage is not set when the variation in the resistance of the first and second transfer members is not accurately measured, a method to alleviate transfer faults caused by errors of the transfer voltage, or image loss caused by overvoltage, is required.

SUMMARY OF THE INVENTION

The present inventive concept provides a transfer voltage control method of an image forming apparatus to control an optimum voltage by measuring a variation in resistance of a transfer unit.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a transfer voltage control method of an image forming apparatus, the method including supplying a first measurement voltage to a first transfer member and a second transfer member, measuring a variation in resistance of the first transfer member by supplying a second measurement voltage to the first transfer member during a first period of time T1, and measuring a variation in resistance of the second transfer member by supplying the second measurement voltage during a time T2.

The measuring the variation in the resistance of the first and second transfer members may be executed at a predetermined interval.

An absolute value of the second measurement voltage may be greater than an absolute value of the first measurement voltage, may be a result of increasing the first measurement voltage by predetermined amounts of voltage, and may be supplied two to three times.

The variation in the resistance of the first and second transfer members may be computed as an average of variation values in resistance of a plurality of second measurement voltages.

The first period of time required to supply increased voltage to the first transfer member may be set differently from the second period of time required to supply the increased voltage to the second transfer member.

The first transfer member may be a transfer drum, and the second transfer member may be a transfer roller.

The foregoing and/or other aspects and utilities of the present general inventive concept may also be achieved by providing a transfer voltage control method of an image forming apparatus, the method including supplying a first measurement voltage to a transfer drum and a transfer roller, measuring a variation in resistance by supplying a second measurement voltage to the transfer drum during a first period of time, changing the second measurement voltage supplied to the transfer drum into the first measurement voltage, measuring a variation in resistance by supplying the second measurement voltage to the transfer roller during a second period of time, and releasing the voltage supplied to the transfer drum and the transfer roller.

An absolute value of the second measurement voltage may be greater than an absolute value of the first measurement voltage, and may be a result of increasing the first measurement voltage by predetermined amounts of voltage.

The foregoing and/or other aspects and utilities of the present general inventive concept may also be achieved by providing a transfer voltage control method of an image forming apparatus including supplying a first measurement current to a transfer drum and a transfer roller, measuring a variation in resistance by supplying second measurement current to the transfer drum during a first period of time, changing the second measurement current supplied to the transfer drum into the first measurement current, measuring a variation in resistance by supplying second measurement current to the transfer roller during a second period of time, and releasing the current supplied to the transfer drum and the transfer roller.

The second measurement current may be greater than the first measurement current.

The second measurement current may be a result of increasing the first measurement current by predetermined amounts of current.

The foregoing and/or other aspects and utilities of the general inventive concept may also be achieved by providing an image forming apparatus including a developing unit to develop an image, a transfer unit to transfer the image, and having a first transfer member and a second transfer member and a high voltage power supply to transmit a transfer voltage to the developing unit and the transfer unit, wherein the transfer voltage is an optimum transfer voltage that reflects accurately measured variations in resistances of the first transfer member and the second transfer member, respectively.

The foregoing and/or other aspects and utilities of the general inventive concept may also be achieved by providing a transfer voltage controlling unit usable with an image forming apparatus, the transfer voltage controlling unit including a power supply to supply a first measurement current to a first transfer member and a second transfer member and a measuring unit to measure a variation in resistance of the first transfer member and the second transfer member, respectively, wherein the variation of the first transfer member and the second transfer member is measured by the power supply supplying a second measurement current to the first transfer member during a first period of time and to the second transfer member during a second period of time, respectively.

The foregoing and/or other aspects and utilities of the general inventive concept may also be achieved by providing a transfer voltage control method of an image forming apparatus, the method including developing an image by a developing unit, transferring the image by a transfer unit having a first transfer member and a second transfer member and supplying a transfer voltage to the developing unit and the transfer unit so that the transfer voltage is an optimum transfer voltage that reflects accurately measured variations in resistances of the first transfer member and the second transfer member, respectively.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
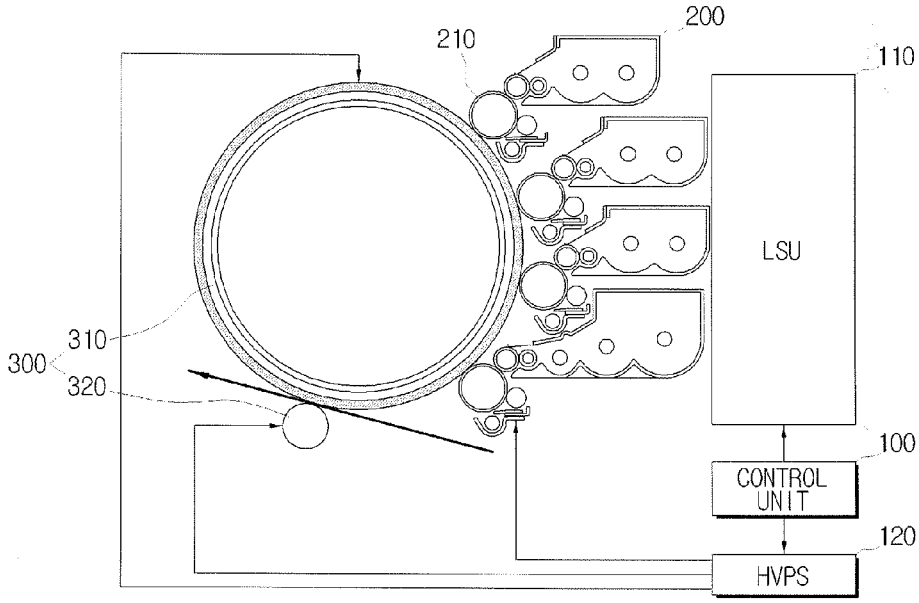
FIG. 1 is a schematic perspective view illustrating an image forming apparatus according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

In the following description, same drawing reference numerals are used for the same elements even in different drawings. The matters defined in the description, such as detailed construction and elements, are provided to assist in a comprehensive understanding of the general inventive concept. Thus, it is apparent that the present general inventive concept can be carried out without those specifically defined matters. Also, well-known functions or constructions are not described in detail since they would obscure the general inventive concept with unnecessary detail.

FIG. 1 is a schematic perspective view illustrating an image forming apparatus according to an exemplary embodiment of the present general inventive concept.

As illustrated in FIG. 1, a control unit 100 outputs a control signal to a laser scanning unit 110, and a high voltage power supply (HVPS) 120.

The laser scanning unit 110 exposes a photosensitive medium 210 provided in a developing unit 200 according to a control signal from the control unit 100. Accordingly, a latent image is formed on the photosensitive medium 210, a toner is pasted thereon, and the latent image is developed.

The HVPS 120 transmits a transfer voltage to the developing unit 200 and a transfer unit 300, according to the control signal of the control unit 100. The transfer unit 300 may include a first transfer member 310 and a second transfer member 320. The first transfer member 310 may be a transfer drum, and the second member 320 may be a transfer roller. The first transfer member 310, for example, may alternatively be a transfer belt.

A variation in resistance due to environmental conditions and production dates of the transfer unit 300 is reflected in a setting of the transfer voltage in order to set an optimum transfer voltage.

Figure 2A:
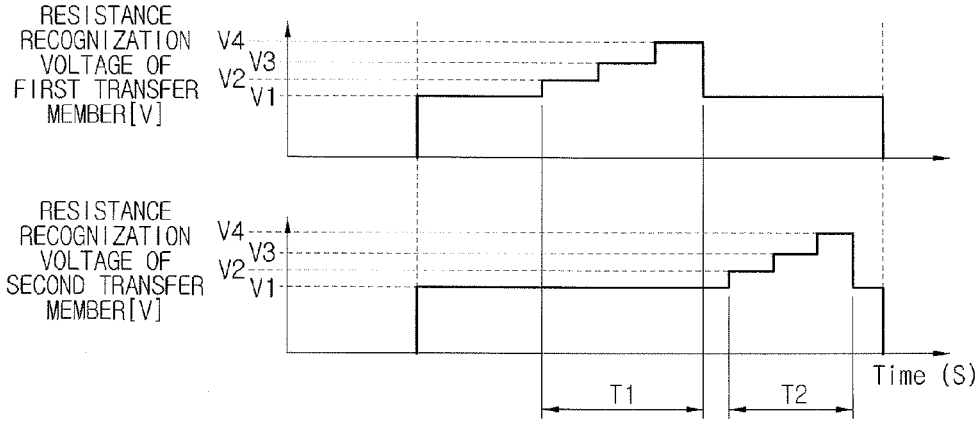
FIGS. 2A and 2B are graphs illustrating a state in which measurement voltage is supplied to a transfer unit after a voltage is supplied concurrently to a transfer belt and transfer roller, to set a transfer voltage to an optimum level in an image forming apparatus according to an exemplary embodiment of the present general inventive concept.
Figure 2B:
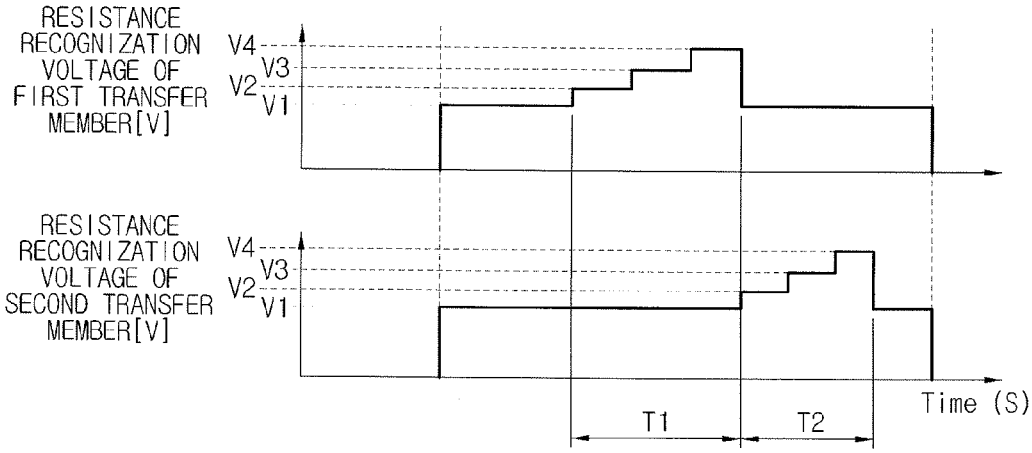

Referring to FIGS. 2A to 2B, a first measurement voltage V1 to measure variation in the resistance of the transfer unit 300 including the first and second transfer members 310 and 320 is concurrently supplied to the first and second transfer members 310 and 320.

Second measurement voltages V2, V3, V4 which increase by predetermined amounts of voltage are each supplied to the first and second transfer members 310 and 320 for a predetermined period of time to separately measure variation in the resistance of the first and second transfer members 310 and 320. A variation in the resistance of the first and second transfer members 310 and 320 may be measured without error. Accordingly, in the present embodiment, the transfer voltage is set using an accurately measured variation in the resistances of the first and second transfer members 310 and 320 of the transfer unit 300 obtained through the use of the first measurement voltage V1, and the second measurement voltages V2, V3 and V4.

A process of measuring a variation in the resistance will be explained in detail with reference to FIGS. 3 to 5.

Figure 3:
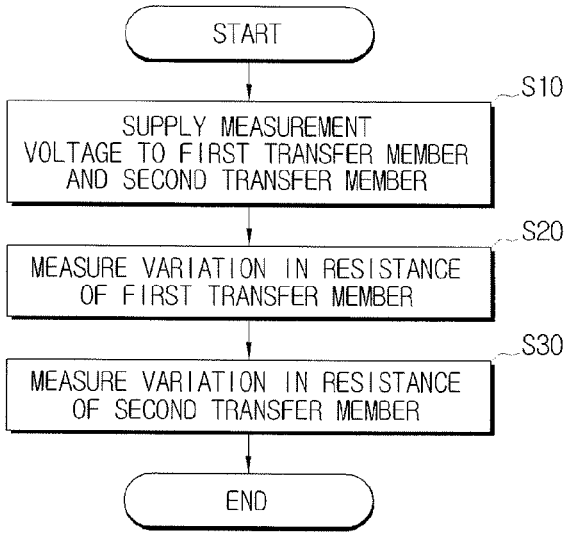
FIGS. 3 to 5 are flowcharts illustrating a method of controlling a transfer voltage in an image forming apparatus according to an exemplary embodiment of the present general inventive concept.
Figure 4:
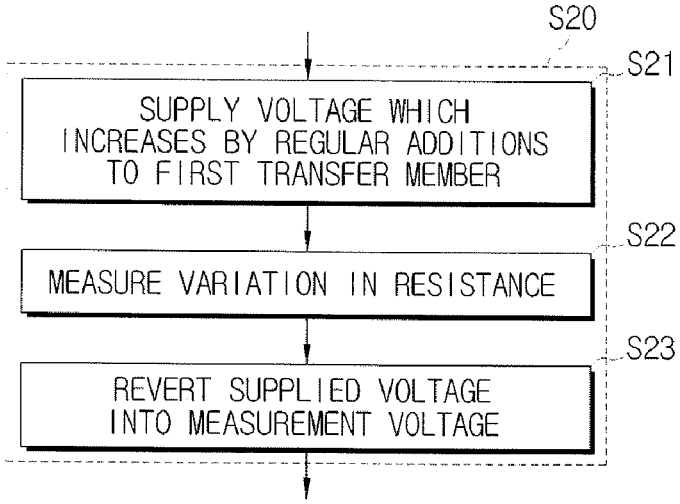

Referring to FIG. 3, the control unit 100 supplies the first measurement voltage V1 to the transfer unit 300 including the first and second transfer members 310 and 320 to measure the variation in the resistance of the transfer unit 300, and to set the optimum transfer voltage.

The first measurement voltage V1 is concurrently supplied to the first and second transfer member 310 and 320, and the first measurement voltage V1 may be 500 to 600 volts. In operation S10, the first measurement voltage V1 is transmitted to the second transfer member 320 and the photosensitive medium 210 in contact with the first transfer member 310, such that a closed circuit is formed.

If the closed circuit is formed by the first measurement voltage V1 as in operation S10 above, in operation S20 the variation in the resistance of the first transfer member 310 is measured first, and the second measurement voltages V2, V3, V4 which increase by predetermined amounts of voltage are supplied two to three times at a predetermined period of time T1 to measure the variation in the resistance of the first transfer member 310. Referring to FIG. 4, in operation S21, potential differences of the second measurement voltages V2, V3, V4 may be 50 to 100 volts. The control unit 100 measures the variation in the resistance according to the voltage increase by sensing variation in the amperage. The average of the measured variation values in the resistance is computed, and in operation S22, the variation in the resistance of the first transfer member 310 is computed. When the computation is completed, the control unit 100 supplies the first measurement voltage V1 which is supplied first to the first transfer member 310 such that in operation S23 the closed circuit is formed in the first and second transfer members 310 and 320, and the photosensitive medium 210 by supplying the first measurement voltage V1.

Figure 5:
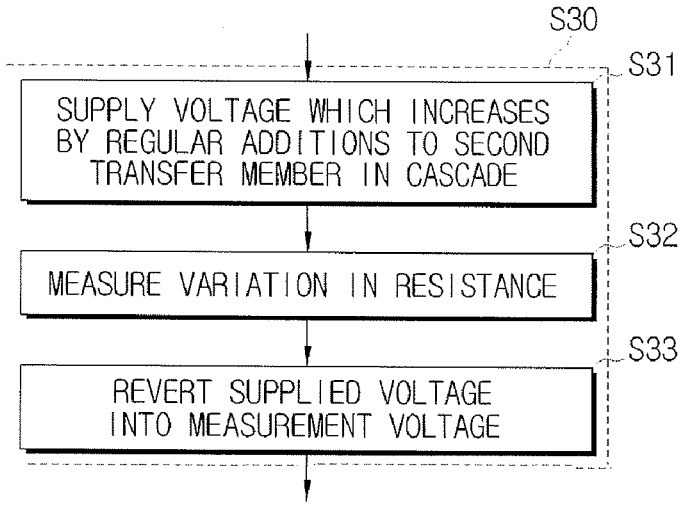

Referring to FIGS. 3 and 5, if the measurement of the variation in the resistance of the first transfer member 310 is completed in operation S20 above, in operation S30 the variation in the resistance of the second transfer member 320 is computed in the same manner as in the first transfer member 310 after the closed circuit is formed using the first measurement voltage V1 in above operation S23. That is, in operation S31 the second measurement voltages V2, V3, V4 which increase by predetermined amounts of voltage are supplied to the second transfer member 320 at a predetermined period of time T2, and a difference in the voltage may be set in a same range of 50 to 100 volts as in operation S21. The control unit 100 measures the variation in the resistance according to a voltage increase by sensing the variation in the amperage. An average of a measured variation value in the resistance is computed, and in operation S32 the variation in the resistance of the second transfer member 320 is computed. When the computation is completed, in operation S33 the control unit 100 supplies the first measurement voltage V1 supplied initially to the second transfer member 320, and the first and second transfer member 310 and 320 revert to their initial state.

There may be a predetermined period of time as illustrated in FIG. 2A, in operation S20 (FIG. 2) measuring the variation in the resistance of the first transfer member 310, and operation S30 (FIG. 2) measuring the variation in the resistance of the second transfer member 320. Additionally, operation S30 may take place after operation S20 is completed as illustrated in FIG. 2B, in order to improve response speed.

A step voltage supply time T2 in operation S32 above may be set differently from a step voltage supply time T1 in operation S22 above. Because it is unnecessary to measure the variation in the resistance for the same time interval, since a size and material of the first transfer member 310 differ from those of the second transfer member 320.

That is, a diameter and mass of the first transfer member 310 may be greater than those of the second transfer member 320, such that the step voltage supply time T1 required to measure the variation in the resistance of the first transfer member 310 may be longer than the step voltage supply time T2 required to measure the variation in the resistance of the second transfer member 320.

If the HVPS 120 supplies the first measurement voltage V1 concurrently to the first and second transfer member 310 and 320, a closed circuit is formed between the first and second transfer members 310 and 320, and the photosensitive medium 210, such that a current may flow therethrough. If the step voltages V2, V3, V4 are supplied successively to the first transfer member 310 and the second transfer member 320 while the current flows, the variation in the resistance of the first and second transfer members 310 and 320 may be accurately measured.

The control unit 100 may set an optimum transfer voltage to print using the accurately measured variation in the resistance of the first and second transfer members 310 and 320. Accordingly, transfer quality of an image forming apparatus is improved, and image loss due to overvoltage is prevented.

The first measurement voltage V1 supplied to the first and second transfer members 310 and 320 may be lower than the transfer voltage which is set by the above process, as it is unnecessary to supply such a high transfer voltage to measure the variation in the resistance of the first and second transfer members 310 and 320. Each apparatus has a difference in transfer voltage, but the optimum transfer voltage may be approximately +1000 to 1400 volts. Therefore, the first measurement voltage V1 may be 500 to 600 volts.

The variation in the resistance of the second transfer member 320 is measured after the variation in the resistance of the first transfer member 310 is measured in the above exemplary embodiment of the present general inventive concept, but the variation in the resistance may be measured in the reverse order.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

The present general inventive concept is described based on an implementation of voltage stabilization which supplies a predetermined voltage, and measures the variation in resistance based on the measurement of a current variation. However, an implementation of a current stabilization to supply a predetermined current, and measures the variation in resistance based on the measurement of a voltage variation, is also applicable to the present general inventive concept.

According to the current stabilization, the first measurement current is input, and the resistance may be measured based on the voltage variation of the second measurement current which is increased from the first measurement current by predetermined amounts of current.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

According to various embodiments of an exemplary embodiment of the present general inventive concept, a variation in a resistance of a transfer unit is measured accurately such that an optimum transfer voltage may be set. Accordingly, transfer quality of an image forming apparatus is improved.

What is claimed is:

1. A transfer voltage control method of an image forming apparatus, the method comprising:

supplying a first measurement voltage to a first transfer member and a second transfer member;

measuring a variation in resistance of the first transfer member by supplying a second measurement voltage to the first transfer member during a first period of time; and measuring a variation in resistance of the second transfer member by supplying the second measurement voltage to the second transfer member during a second period of time.

2. The method of claim 1, wherein the measuring the variation in the resistance of the first and second transfer members is executed at a predetermined interval.

3. The method of claim 2, wherein an absolute value of the second measurement voltage is greater than an absolute value of the first measurement voltage.

4. The method of claim 3, wherein the absolute value of the second measurement voltage is a result of increasing the absolute value of the first measurement voltage by predetermined amounts of voltage.

5. The method of claim 4, wherein the second measurement voltage is supplied two to three times.

6. The method of claim 5, wherein the variation in the resistance of the first and second transfer members is computed as an average of variation values in resistance of a plurality of second measurement voltages.

7. The method of claim 1, wherein the first period of time required to supply increased voltage to the first transfer member is differently set from the second period of time required to supply the increased voltage to the second transfer member.

8. The method of claim 1, wherein the first transfer member is a transfer drum, and the second transfer member is a transfer roller.

9. A transfer voltage control method of an image forming apparatus, the method comprising:

supplying a first measurement voltage to a transfer drum and a transfer roller;

measuring variation in resistance by supplying a second measurement voltage to the transfer drum during a first period of time;

changing the second measurement voltage supplied to the transfer drum into the first measurement voltage;

measuring a variation in resistance by supplying the second measurement voltage to the transfer roller during a second period of time; and releasing the voltage supplied to the transfer drum and the transfer roller.

10. The method of claim 9, wherein an absolute value of the second measurement voltage is greater than an absolute value of the first measurement voltage.

11. The method of claim 10, wherein the absolute value of the second measurement voltage is a result of increasing the absolute value of the first measurement voltage by predetermined amounts of voltage.

12. A transfer voltage control method of an image forming apparatus, the method comprising:

supplying a first measurement current to a transfer drum and a transfer roller;

measuring a variation in resistance by supplying a second measurement current to the transfer drum during a first period of time T1;

changing the second measurement current supplied to the transfer drum into the first measurement current;

measuring a variation in resistance by supplying the second measurement current to the transfer roller during a second period of time; and releasing the current supplied to the transfer drum and the transfer roller.

13. The method of claim 12, wherein the second measurement current is greater than the first measurement current.

14. The method of claim 13, wherein the second measurement current is a result of increasing the first measurement current by predetermined amounts of current.

15. An image forming apparatus, comprising:

a developing unit to develop an image;

a transfer unit to transfer the image, and having a first transfer member and a second transfer member;

a high voltage power supply to transmit a transfer voltage to the developing unit and the transfer unit;

a transfer voltage controlling unit including a power supply to supply a first measurement voltage to the first transfer member and the second transfer member; and a measuring unit to measure the variation in resistance of the first transfer member and the second transfer member, respectively, wherein the transfer voltage is an optimum transfer voltage that reflects accurately measured variations in resistances of the first transfer member and the second transfer member, respectively, and wherein the variation of the first transfer member and the second transfer member is measured by the power supply supplying a second measurement voltage to the first transfer member during a first period of time and to the second transfer member during a second period of time, respectively.

16. The transfer voltage controlling unit of claim 15, wherein the power supply supplies the first measurement voltage concurrently to the first transfer member and the second transfer member.

17. The transfer voltage controlling unit of claim 16, wherein the power supply supplies a first measurement current concurrently to the first transfer member and the second transfer member.

* * * * *